US009324556B2

(12) United States Patent
Shimoi et al.

(10) Patent No.: US 9,324,556 B2
(45) Date of Patent: Apr. 26, 2016

(54) FIELD ELECTRON EMISSION FILM, FIELD ELECTRON EMISSION DEVICE, LIGHT EMISSION DEVICE, AND METHOD FOR PRODUCING THEM

(71) Applicants: TOHOKU UNIVERSITY, Miyagi (JP); DOWA HOLDINGS CO., LTD., Tokyo (JP)

(72) Inventors: Norihiro Shimoi, Miyagi (JP); Kazuyuki Tohji, Miyagi (JP); Yasumitsu Tanaka, Miyagi (JP); Hiroyuki Kai, Tokyo (JP)

(73) Assignees: TOHOKU UNIVERSITY, Miyagi (JP); DOWA HOLDINGS CO., LTD., Tokyo (JP)

( * ) Notice: Subject to any disclaimer, the term of this patent is extended or adjusted under 35 U.S.C. 154(b) by 0 days.

(21) Appl. No.: 14/424,074

(22) PCT Filed: Aug. 12, 2013

(86) PCT No.: PCT/JP2013/071772
§ 371 (c)(1),
(2) Date: Feb. 26, 2015

(87) PCT Pub. No.: WO2014/034423
PCT Pub. Date: Mar. 6, 2014

(65) Prior Publication Data

US 2015/0228471 A1 Aug. 13, 2015

(30) Foreign Application Priority Data

Aug. 29, 2012 (JP) ..... 2012-188332
Oct. 10, 2012 (JP) ..... 2012-225554

(51) Int. Cl.

| | |
|---|---|
| ***H01J 63/06*** | (2006.01) |
| ***H01J 1/304*** | (2006.01) |
| ***H01J 9/02*** | (2006.01) |
| ***H01J 31/12*** | (2006.01) |
| ***H01J 63/02*** | (2006.01) |

(52) U.S. Cl.
CPC ..... *H01J 63/06* (2013.01); *H01J 1/304* (2013.01); *H01J 9/025* (2013.01); *H01J 31/127* (2013.01); *H01J 63/02* (2013.01); *H01J 2201/30469* (2013.01); *H01J 2329/0455* (2013.01); *Y10T 428/24479* (2015.01); *Y10T 428/24612* (2015.01)

(58) Field of Classification Search
CPC ..... H01J 63/06; H01J 1/304; H01J 9/025; H01J 31/127; H01J 63/02
USPC ..... 313/495
See application file for complete search history.

(56) References Cited

FOREIGN PATENT DOCUMENTS

| | | |
|---|---|---|
| JP | 2001-035360 | 2/2001 |
| JP | 2001-035361 | 2/2001 |
| JP | 2005-025970 | 1/2005 |
| JP | 2010-086966 | 4/2010 |

*Primary Examiner* — Tracie Y Green
(74) *Attorney, Agent, or Firm* — Clark & Brody

(57) ABSTRACT

A field electron emission film that is capable of being operated with low electric power and enhancing the uniformity in luminance within the light emission surface contains from 60 to 99.9% by mass of tin-doped indium oxide and from 0.1 to 20% by mass of carbon nanotubes. The film has a structure wherein grooves having a width in a range of from 0.1 to 50 mm are formed in a total extension of 2 mm or more per 1 $mm^2$ on a surface of the film, and carbon nanotubes are exposed on a wall surface of the grooves. After forming an ITO film containing carbon nanotubes on a substrate, grooves are formed on a surface of the ITO film, and the end portions of the carbon nanotubes exposed to the wall surface of the grooves are designated as an emitter.

5 Claims, 2 Drawing Sheets

FIELD ELECTRON EMISSION FILM, FIELD ELECTRON EMISSION DEVICE, LIGHT EMISSION DEVICE, AND METHOD FOR PRODUCING THEM

TECHNICAL FIELD

The present invention relates to a field electron emission film emitting electrons with an intense electric field, a field electron emission device (field electron emission electrode) and a light emission device using the same, and methods for producing them. More specifically, the invention relates to a field electron emission device utilized in a display device, a light source of backlight for a non-luminescent display, an illumination lamp, and the like, and a surface light emission device using the same as a surface electron source.

The present application claims priority to Japanese Patent Application No. 2012-188332 filed on Aug. 29, 2012, and Japanese Patent Application No. 2012-225554 filed on Oct. 10, 2012, which are incorporated herein by reference.

BACKGROUND ART

A field emission display (FED) has been studied and developed as a next-generation high-luminance flat panel display. An incandescent lamp and a fluorescent lamp have been used over the years as a light emission device for general illumination, and a fluorescent lamp has such characteristics that the electric power consumption thereof may be suppressed as compared to an incandescent lamp for the same luminosity, and is being widely used as illumination. In late years, a display device and illumination using a light emitting diode (LED) as a light source are developed as a substitute of the ordinary illumination, such as an incandescent lamp and a fluorescent lamp, and are being popularized. Most recently, they are utilized in a display device, such as a traffic light, a backlight for LCD, various illumination devices, and the like.

LED functions by the theory of light emission caused by recombination of the carriers of the semiconductor, and thus emits monochromatic light having an inherent wavelength that is determined by the band structure of the material, and furthermore LED is a point light source. Accordingly, LED is not suitable particularly for an application to uniform emission in a large area such as a backlight or illumination, or light having a broad wavelength range, such as white light. In the case of display in white, particularly, such a constitution is necessarily employed that LED is used as an ultraviolet ray emission device, and a fluorescent material is made to emit light with the ultraviolet ray.

It may be considered on the other hand that a thin and high-luminance surface light emission device is obtained easily by making a fluorescent material to emit light with electrons emitted from a surface electron emission source by the similar process as FED.

In field emission type electron emission source (i.e., a field emitter), when the intensity of the electric field applied to a substance is increased, the width of the energy barrier on the surface of the substance is gradually narrowed corresponding to the intensity of the electric field, and under an intense electric field having an electric field intensity of $10^7$ V/cm or more, electrons in the substance may run through the energy barrier by the tunnel effect. The phenomenon that the substance emits electrons accordingly is thus utilized. In this case, the electric field is in accordance with Poisson equation, and thus cold electrons may be efficiently emitted with a relatively low extraction voltage by forming a portion where the electric field is concentrated in the member that emits electrons (i.e., the emitter).

In recent years, carbon nanotubes (which may be hereinafter referred to as CNT) are receiving attention as an emitter material. CNT is a hollow cylinder formed by rolling up a graphene sheet having carbon atoms regularly arranged, and the outer diameter thereof is in a nanometer order, whereas the length thereof is generally from 0.5 μm to several tens micrometer, which provides a considerably high aspect ratio. CNT is expected to have a high electron emission capability since the electric field is liable to be concentrated thereon due to the shape thereof. CNT also has such features as high chemical and physical stability, and thus it is expected that CNT is hard to receive influence of adsorption of the residual gas, ion impact and the like in vacuum where the emitter is operated.

As a production method of an electron emission source using CNT, a method of coating a dispersion liquid containing CNT on a substrate, followed by drying and baking, is considered to be excellent in productivity and production cost, and thus has been studied variously.

CNT is in the form of very fine fibrous fine particles (powder), and in the case where an electron emission source is formed by using CNT, it is necessary to fix CNT to a substrate. In general, a binder material, such as a resin, is used for fixing CNT. Specifically, a binder material and CNT are mixed with and dispersed in a solvent to form a paste (or an ink), which is coated on the surface of the substrate by such a measure as a printing method, a spraying method, or a die coater method, followed by drying and baking, so as to fix CNT onto the substrate by utilizing the adhesiveness of the binder material. In the case where CNT is fixed onto the substrate by this method, CNT itself is in the state where it is embedded in the binder material, and accordingly, for realizing high electron emission characteristics, such a method has been employed that CNT is exposed, and CNT is arranged perpendicular to the substrate. For example, PTL 1 describes the technique, in which a porous sheet member having adhesiveness is adhered to a surface of a layer containing CNT, followed by drying, and then the sheet member is peeled off, thereby exposing CNT and arranging CNT perpendicularly. Furthermore, PTL 2 describes the technique, in which a layer containing CNT is dry-etched. Moreover, as a method for exposing CNT present inside a film, PTL 3 proposes the method, in which a film, which has been formed by coating a composition containing CNT, an oligomer, a crosslinkable monomer, a polymerization initiating material and a solvent on a substrate, is subjected to a heat treatment to form cracks in the film with thermal stress, and thus CNT is exposed inside the cracks, thereby providing an electron emission source.

CITATION LIST

Patent Literatures

PTL 1: JP-A-2001-035360
PTL 2: JP-A-2001-035361
PTL 3: JP-A-2010-086966

SUMMARY OF INVENTION

Technical Problem

The characteristics that are demanded for a light emission device using a field electron emission device (field electron emission electrode) include a high luminance, a high uniformity in luminance within the light emission surface, light emission with low electric power, less flicker in light emission state, and the like. However, in the case where a light emission device is formed with a field electron emission device (field electron emission electrode) by applying the techniques of PTLs 1 to 3, there is a problem that it is difficult to enhance the uniformity in light emission luminance within the light emission surface. In the method described in PTL 1, it is difficult to control the adhesiveness between the adhesive sheet member and CNT, and there is a problem that CNT is exposed non-uniformly on peeling the sheet member. In the method described in PTL 2, dry etching is performed for exposing CNT, but there is a problem that CNT is deteriorated on etching. The methods described in PTLs 1 and 2 are less effective for exposing CNT that is arranged horizontally with respect to the substrate, and thus such a process step is required that CNT is raised. In these methods, furthermore, the use of an organic binder and an organic solvent for forming the film may prevent the formation of a film having high conductivity. In the technique described in PTL 3, it is necessary to use a resin as the major component of the film, and there is a problem that it is difficult to enhance the conductivity of the film, and it is not easy to control the density and the distribution of the cracks for exposing CNT, thereby preventing the results including high in-plane uniformity of luminance and light emission with low electric power.

An object of the invention is to provide a field electron emission film emitting electrons with an intense electric field that is capable of, on using in a light emission device, being operated with low electric power and enhancing the uniformity in luminance within the light emission surface, a field electron emission device (field electron emission electrode), a light emission device using the same, and methods for producing them. Another object of the invention is to provide a field electron emission film that does not require a step of removing a part of a film surface by etching or the like and a step of raising for providing the field electron emission film, and a method for producing the same.

Solution to Problem

For achieving the objects, the invention provides the following.

(1) A field electron emission film having such a structure that a film containing from 60 to 99.9% by mass of tin-doped indium oxide (which is hereinafter referred to as ITO) and from 0.1 to 20% by mass of CNT is formed, grooves having a width in a range of from 0.1 to 50 μm are formed in a total extension of 2 mm or more per 1 $mm^2$ on a surface of the film, and carbon nanotubes are exposed on a wall surface of the grooves.

(2) A field electron emission device having the field electron emission film formed on a substrate.

(3) A light emission device containing the field electron emission device (cathode electrode) and a structure (anode) being disposed to face the field electron emission device and containing at least an anode electrode and a fluorescent material, a space between the field electron emission device and the anode being maintained vacuum.

(4) A method for producing a field electron emission film, containing: coating a CNT dispersion liquid containing an organic indium compound, a tin alkoxide, and CNT, on a substrate, and heating the dispersion liquid to form an ITO film containing CNT (which is hereinafter referred to as a CNT-containing ITO film); and then forming grooves having a width in a range of from 0.1 to 50 μm in a total extension of 2 mm or more per 1 $mm^2$ on a surface of the CNT-containing ITO film.

(5) A method for producing a field electron emission film, containing: coating a CNT dispersion liquid containing an organic indium compound, one kind or two kinds of a tin alkoxide, ITO particles, and CNT, on a substrate, and heating the dispersion liquid to form a CNT-containing ITO film; and then forming grooves having a width in a range of from 0.1 to 50 μM in a total extension of 2 mm or more per 1 $mm^2$ on a surface of the CNT-containing ITO film.

(6) The method for producing a field electron emission film, wherein a formation method of the grooves is a mechanical measure, and particularly mechanical grinding with abrasive grains by using sandpaper.

Advantageous Effects of Invention

In the invention, as described above, the major component of the field electron emission film is ITO having conductivity, which contains CNT, thereby providing a field electron emission device capable of being operated with low electric power. Furthermore by forming grooves on the film, CNT inside the film is easily exposed, thereby providing a light emission device using a field electron emission device having high uniformity in luminance with the light emission surface.

DESCRIPTION OF EMBODIMENTS

Field Electron Emission Film

Figure 1:
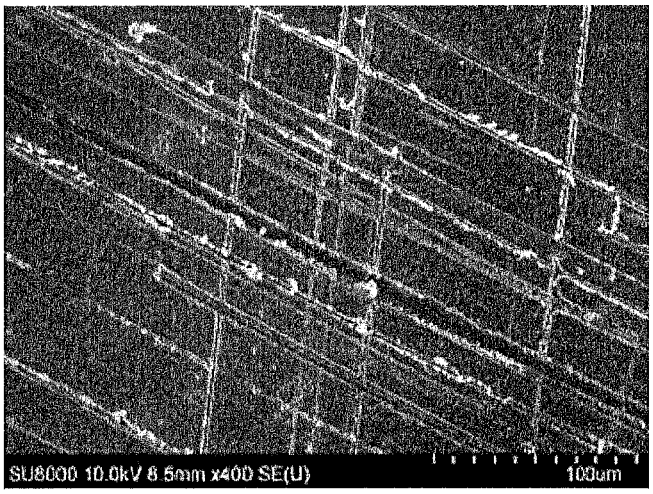
FIG. 1 is a scanning electron micrograph of the surface of a CNT-containing ITO film having grooves formed by grinding with sandpaper.

The field electron emission film of the invention has such a structure that grooves are formed on the surface of a film containing ITO as a major component and a slight amount of CNT, and the end portions of CNT are exposed on the wall surface of the grooves. The content of ITO in the field electron emission film is preferably 60% by mass or more. When the content is less than 60% by mass, the conductivity of the film may be too low to provide a possibility that the in-plane distribution of the light emission intensity as a field electron emission device may be non-uniform. ITO may be contained up to 99.9% by mass in the field electron emission film, and in consideration of the balance with the content of CNT, the content thereof is preferably from 80 to 99.8% by mass, more preferably from 90 to 99.8% by mass, and further preferably from 95 to 99.5% by mass. ITO is an indium oxide having tin oxide forming a solid solution therewith, and the composition thereof varies depending on the production condition thereof. There are cases where an organic component may partly remain when an organic metal is used as a starting material and the baking temperature is low, but the content of ITO in the invention is a value that is calculated based on the assumption that indium and tin contained in the field electron emission film are in the form of stoichiometric oxides, respectively.

The field electron emission film of the invention contains CNT as an emitter. The kind of CNT used is not particularly limited, and single-wall CNT is preferably used. Single-wall CNT is advantageously used from the standpoint of reduction of the electron emission electric field and the electron emission driving voltage. The content of CNT in the field electron emission film is preferably in a range of from 0.1 to 20% by mass. When the content is less than 0.1% by mass, there is a possibility that the emission of electrons is insufficient, and when the content exceeds 20% by mass, expensive CNT may be used in a large amount, which is economically disadvantageous due to the increased production cost of the film. In consideration of the balance above, the content of CNT in the field electron emission film is more preferably from 0.2 to 10% by mass, and further preferably from 0.5 to 5% by mass.

The thickness of the field electron emission film is preferably from 0.5 to 100 μm. The thickness that is less than 0.5 μm is not preferred since the selection of the measures for forming the grooves may be restricted. The thickness that exceeds 100 μm is not preferred since the material cost may be increased.

The field electron emission film of the invention has such a structure that grooves are formed on the surface of the film.

In a film obtained by coating and baking a material containing CNT dispersed in a liquid, in general, CNT is not necessarily present perpendicular to the substrate, and a certain portion thereof may present horizontally or nearly horizontally with respect to the substrate. Accordingly, even when the surface of the aforementioned baked film is partly removed, it is often difficult to expose CNT effectively, and a raising treatment may be required in some cases. In the invention, in which grooves are formed in the film, on the other hand, the end portions of CNT that are present horizontally or nearly horizontally with respect to the substrate inside the film may be effectively exposed, and the raising treatment may be unnecessary.

The width of the grooves formed on the surface of the field electron emission film of the invention is preferably in a range of from 0.1 to 50 μm. The width of the grooves that is less than 0.1 μm is not preferred since there is a possibility that the end portion of CNT may not be necessarily exposed even though CNT is partly exposed, and the selection of the measures for forming the grooves may be restricted. The width of the grooves that exceeds 50 μm is not preferred since CNT contained in the film may be unnecessarily removed, and in the case where a light emission device is formed, there is a possibility that the in-plane uniformity of light emission may be lowered. The width of the grooves may be measured with an optical microscope or a scanning electron microscope.

The depth of the grooves formed on the surface of the field electron emission film is preferably 0.1 μm or more. In the case where the depth of the grooves is less than 0.1 μm, the exposure amount of CNT may be insufficient. The upper limit of the depth of the grooves is not particularly determined, and may be equivalent to the thickness of the field electron emission film, i.e., the grooves may be formed to reach the substrate.

The grooves having a width in a range of from 0.1 to 50 μm formed on the surface of the field electron emission film are preferably present in a total extension of 2 mm or more per 1 $mm^2$. When the total extension is less than 2 mm, the light emission intensity of the light emission device may be lowered, and the in-plane distribution of the light emission intensity thereof may be deteriorated. When the grooves having a width in a range of from 0.1 to 50 μm are present in a total extension of 2 mm or more, portions having the width of the grooves that is less than 0.1 μm or exceeds 50 μm may be present in the same region. The length of the grooves may be measured with an optical microscope or a scanning electron microscope. The total extension of the grooves having a width in a range of from 0.1 to 50 μm per 1 $mm^2$ may be obtained in such a manner that the grooves in a region of 1 mm×1 mm are measured for the lengths thereof with a width in a range of from 0.1 to 50 μm, and the sum of the lengths is obtained.

Field Electron Emission Device (Field Electron Emission Electrode)

The field electron emission device (field electron emission electrode) of the invention has the field electron emission film of the invention formed on a support, such as a substrate. The kind of the substrate is not particularly limited, it may be said that it is advantageous when the substrate is conductive since the degree of freedom of the electric connection method may be enhanced. Preferred examples of the substrate include a semiconductor substrate, such as a silicon substrate, and a metal substrate.

Light Emission Device

The light emission device of the invention contains the field electron emission device (field electron emission electrode) of the invention and a structure (anode) being disposed to face the field electron emission device and containing an anode electrode and a fluorescent material, and a space between the field electron emission device and the anode is maintained vacuum. According to the constitution, a light emission device that has high in-plane uniformity in luminance may be obtained. Furthermore, the light emission device of the invention may have an electrode (i.e., a gate electrode or a grid electrode) at a position that is nearer to CNT (between the cathode and the anode) for reducing the electron emission voltage applied to CNT required for emitting field electrons. The vacuum herein means a state depressurized to such an extent that does not impair light emission of the light emission device.

The anode used may contain an anode electrode formed on a substrate, and a fluorescent material coated thereon. The anode used may be one that is used in a light emission device using a known field electron emission device. Examples thereof used include one containing an ITO film as an anode electrode formed on a glass substrate, and a fluorescent material coated thereon.

Method for producing Field Electron Emission Film

The field electron emission film of the invention may be obtained by coating a dispersion liquid containing a component containing indium and a component containing tin, which are precursors of ITO, and CNT (i.e., a CNT dispersion liquid) on a substrate, heating and baking the dispersion liquid to form a CNT-containing ITO film, and then forming grooves on the surface of the film.

CNT Dispersion Liquid

Examples of the indium component added to the CNT dispersion liquid include an organic indium compound and ITO powder. Examples of the organic indium compound used include a trialkylindium and an indium alkoxide. From the standpoint of handleability, preferred examples of the trialkylindium include tributylindium. The alkoxide is not particularly limited in kind thereof, as far as it is changed to an oxide by heating, such as a methoxide, an ethoxide, a butoxide and an isopropoxide.

The ITO powder, which is also the tin component, may adversely affect the dispersibility of CNT when the particle diameter thereof is too large, and thus the average particle diameter thereof is preferably 10 μm or less, and more preferably 0.1 μm or less.

Examples of the tin component added to the CNT dispersion liquid include a tin alkoxide and ITO powder. As similar to the indium alkoxide, the alkoxide is not particularly limited in kind thereof, as far as it is changed to an oxide by heating, such as a methoxide, an ethoxide, a butoxide and an isopropoxide.

Examples of the precursors of ITO include a combination of an organic indium compound and a tin alkoxide, and a combination of an organic indium compound, one kind or two kinds of a tin alkoxide, and ITO powder. The kind of CNT used is not particularly limited, and single-wall CNT is preferably used. The kind of the solvent used is not particularly limited, and in the case where an alkoxide is used as the indium and tin components, an organic solvent is preferably used from the standpoint of suppressing hydrolysis on mixing. Preferred examples of the organic solvent include an alcohol and butyl acetate.

The CNT dispersion liquid may contain a dispersant, a thickener and the like, in addition to the aforementioned components.

The use of a dispersant may enhance the dispersibility of CNT. The dispersant used may be a known dispersant. Preferred examples thereof include an anionic surfactant, dodecylbenzenesulfonic acid, benzalkonium chloride and sodium benzenesulfonate.

The CNT dispersion liquid may contain a thickener for controlling the viscosity thereof. In the case where the viscosity of the CNT dispersion liquid is low, the addition of a thickener may enhance the coating property of the CNT dispersion liquid, thereby enhancing the adhesiveness between the substrate and the film. The thickener used may be a known thickener. Preferred examples thereof include ethyl cellulose or the like.

In the preparation of the CNT dispersion liquid, the components may be mixed with a ball mill or the like, thereby enhancing the dispersion state of CNT in the CNT dispersion liquid.

Formation of CNT-containing ITO Film

Firstly, the CNT dispersion liquid is coated on the substrate to form a coated film. The coating method used may be a known method, such as spray coating, spin coating and dip coating. Subsequently, the coated film is heated (baked) at from 300 to 600° C. to provide a film containing ITO as a major component and a slight amount of CNT. The baking may be performed in the atmosphere or may be performed in an inert gas, such as nitrogen and argon. Before baking, the coated film may be dried (removal of the solvent component) at a temperature lower than 300° C.

Formation of Grooves

For obtaining the field electron emission film of the invention, it is necessary to form grooves on the surface of the CNT-containing film. The method for forming grooves is not particularly limited, and any of a mechanical method and a chemical method may be used. For preventing CNT from being damaged, a process at as low a temperature as possible is preferably used. Examples of the former include mechanical grinding with sandpaper, and examples of the later include a process of forming grooves by a combination of masking with a photoresist and etching. Any method other than these exemplified methods may be used, as far as the method provides such a state that CNT in the grooves is not entirely removed on forming grooves, but the end portions of CNT remains and are exposed on the wall surface of the grooves.

The mechanical grinding with sandpaper, which forms grooves mechanically with abrasive grains, is preferred since it is a low temperature process, does not damage CNT in the film on forming grooves, and has an effect of exposing CNT by partly removing the surface of the CNT-containing ITO film, in addition to the formation of grooves.

EXAMPLE

CNT Dispersion Liquid

The following components were added to 5.974 g of butyl acetate, which were mixed by stirring to provide a solution.

Tributylindium ($C_{12}H_{27}In$) (containing 0.089 g of In)

Tetrabutoxy tin ($C_{16}H_{36}O_4Sn$) (containing 0.035 g of Sn)

The following components were added to the resulting solution, which were mixed by stirring to provide a CNT-containing liquid.

ITO powder 0.313 g (average primary particle diameter: 25 nm, produced by the method of Example 5 described in JP-A-2011-126746)

Carbon nanotubes (single wall, produced by Hanwha Nanotech Corporation, ASP-100F) 0.01 g Dodecylbenzenesulfonic acid 0.01 g Ethyl cellulose (produced by Kanto Chemical Co., Inc., Ethyl Cellulose 100 cP (ethoxy content: 48 to 49.5%) 0.04 g 4 g of zirconia balls having a diameter of 1 mm were added to the resulting CNT-containing solution, which were subjected to primary stirring for 6 hours by rotating stirring blades, and then the zirconia balls having a diameter of 1 mm were removed. Thereafter, 4 g of zirconia balls having a diameter of 0.3 mm and 4 g of butyl acetate were added thereto, which were subjected to secondary stirring for 6 hours by rotating stirring blades, and then the zirconia balls having a diameter of 0.3 mm were removed. Thereafter, 4 g of zirconia balls having a diameter of 0.05 mm and 2 g of butyl acetate were added thereto, which were subjected to tertiary stirring for 6 hours by rotating stirring blades. Thereafter, the zirconia balls having a diameter of 0.05 mm were removed to provide a CNT dispersion liquid.

The contents of JP-A-2011-126746 are incorporated herein by reference.

CNT-Containing ITO Film

The CNT dispersion liquid was coated on a surface of a Si wafer heated to 150° C. by using an air spray nozzle for coating. At this time, the thickness of the coated film was controlled to provide a thickness of 5 μm after baking. Subsequently, the Si wafer having the CNT dispersion liquid coated thereon was dried by heating under conditions in the air at 250° C. for minutes. Furthermore, the Si wafer having the CNT dispersion liquid coated and dried was baked under conditions in vacuum at 470° C. for 80 minutes to form a CNT-containing ITO film on the Si wafer.

CNT Exposing Treatment

For partly exposing CNT contained in the CNT-containing ITO film, the resulting CNT-containing ITO film was subjected to a treatment, such as formation of grooves by a mechanical treatment, and chemical etching. The CNT-containing ITO film formed on the Si substrate and subjected to the CNT exposing treatment was designated as a cathode electrode.

Evaluation of Grooves

The grooves formed on the CNT-containing ITO film by the CNT exposing treatment were evaluated for the existing density, the width and the depth of the grooves by the following manner.

The width and the length of the grooves were measured for five regions of 1 mm×1 mm on the surface of the film with a scanning electron microscope. The total extension of the grooves with a width in a range of from 0.1 to 50 μm was measured for each of the regions, and the average value thereof was designated as the total extension of the grooves per 1 $mm^2$ of the specimen.

Evaluation of Cathode Electrode

Formation of Light Emission Device

The resulting cathode electrode was cut into a square shape, and spacers (diameter: 45 μm) formed of glass fibers were disposed on and fixed to the two opposing edges of the square shape. A glass plate having ITO vapor-deposited on the surface thereof and a fluorescent material coated thereon was used as an anode electrode. The anode electrode was cut into the same shape as the cathode electrode. The anode electrode was placed on and fixed to the spacers in such a manner that the surface of the anode electrode having the fluorescent material coated thereon faced the surface of the cathode electrode having the CNT-containing ITO film present thereon, thereby forming a light emission device. The light emission area of the light emission device was a square shape having edges of 7 mm.

Evaluation of Light Emission State of Light Emission Device

The cathode electrode and the anode electrode of the resulting light emission device were connected to a power unit and disposed in a vacuum vessel of $10^{-4}$ Pa, and the cathode electrode was applied with 5 kV to make the light emission device to emit light. At that time, light emission state was observed visually and photographed by a CCD camera. The light emission intensity (luminance) of the light emission device was measured with a luminance meter (LS-100, produced by Konica Minolta Optics, Inc.). The luminance was measured for five points on the light emission surface over the viewport of the vacuum vessel.

Example 1

Figure 2:
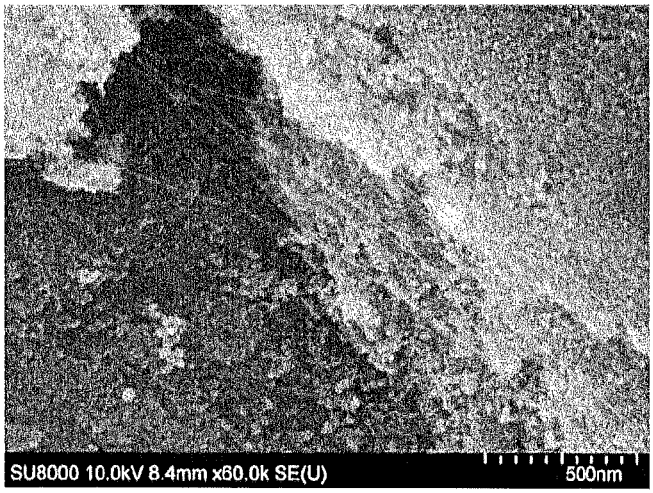
FIG. 2 is a scanning electron micrograph of a groove portion of the CNT-containing ITO film having the grooves formed by grinding with sandpaper.
Figure 3:
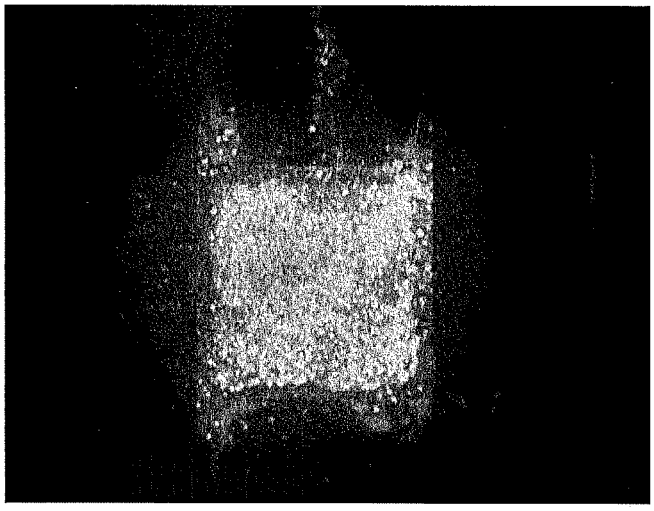
FIG. 3 is a photograph showing the light emission state of a light emission device of Example 1.

For the CNT exposing treatment, the surface of the CNT-containing ITO film was ground twice in each of two directions with #1000 sandpaper defined by JIS R6010:2010 (grain size of abrasive for grinding cloth and paper) to form grooves. The observation results of the surface of the CNT-containing ITO film after grinding is shown in FIG. 1, and the enlarged observation result of the grooves is shown in FIG. 2. The grooves having a width of from 0.1 to 50 μm had a total extension of 50 mm per 1 $mm^2$. The depth of the grooves was measured at 10 points of the grooves with a surface roughness meter, and was 0.1 μm or more in all the points. The thin string-like substances, which appear white on the wall surface of the grooves in FIG. 2, are CNT thus exposed. A light emission device was fabricated and measured for light emission luminance at five points, which were in a range of from 75 to 85 cd/$cm^2$, and the average value thereof was 80 cd/$cm^2$. In this Example, it was confirmed that flicker in light emission (fluctuation in light emission intensity observed visually) was small, and the voltage required for light emission was low, as compared to Comparative Example 1 described later. The result of photographing the light emission state of the light emission device of this Example with a CCD camera is shown in FIG. 3.

Comparative Example 1

An FEL device was formed and evaluated in the same manner as in Example 1 except that the CNT exposing treatment was as follows.

CNT exposing treatment: The surface of the CNT-containing ITO film was removed by dissolution with an etching liquid (ITO-06N, produced by Kanto Chemical Co., Inc.) to the half of the thickness of the film, thereby exposing CNT to the surface of the film. After rinsing and drying the surface, a raising treatment for CNT was performed by adhering a film for ultraviolet ray curing lamination to the surface of the CNT-containing ITO film, followed by peeling therefrom.

Figure 4:
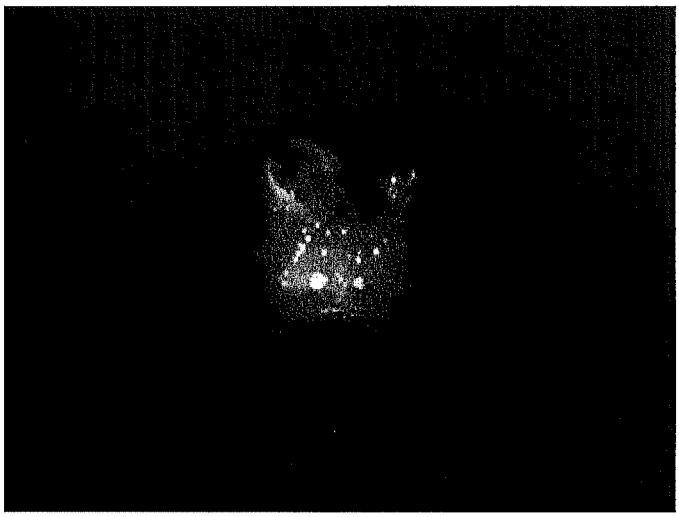
FIG. 4 is a photograph showing the light emission state of a light emission device of Comparative Example 1.

In this Comparative Example, no groove formed was observed although the film was etched. The result of photographing the light emission state of the light emission device of this Comparative Example with a CCD camera is shown in FIG. 4. As compared to Example 1, there was large unevenness in luminance, and regions with no light emission observed were widely present. As a result of measurement of the light emission intensity (luminance), the luminance was from 20 to 100 cd/$cm^2$, and the average value thereof was 60 cd/$cm^2$.

It is considered that the result is obtained since it is difficult to expose the end portions of CNT that are present nearly horizontally with respect the substrate in the CNT-containing ITO film, uniformly on the surface, by etching the film.

Comparative Example 2

The same raising treatment as in Comparative Example 1 was performed without the CNT exposing treatment performed, and then a light emission device was fabricated and evaluated for the light emission state, but no light emission was observed. It is considered that the result is obtained since CNT is not exposed to the surface of the film only by adhering the film for ultraviolet ray curing lamination to the surface of the CNT-containing ITO film, followed by peeling a part thereof.

Example 2

An FEL device was formed and evaluated in the same manner as in Example 1 except that the kind of the sandpaper used was changed from #1000 to #2000.

The grooves having a width of from 0.1 to 50 μm had a total extension of 55 mm per 1 $mm^2$. The depth of the grooves was measured at 10 points of the grooves with a surface roughness meter, and was 0.1 μm or more in all the points. A light emission device was fabricated and measured for light emission luminance at five points, which were in a range of from 107 to 120 cd/$cm^2$, and the average value thereof was 103 cd/$cm^2$. In this Example, it was confirmed that flicker in light emission (fluctuation in light emission intensity observed visually) was small, and the voltage required for light emission was low, as compared to Comparative Example 1.

Example 3

Figure 5:
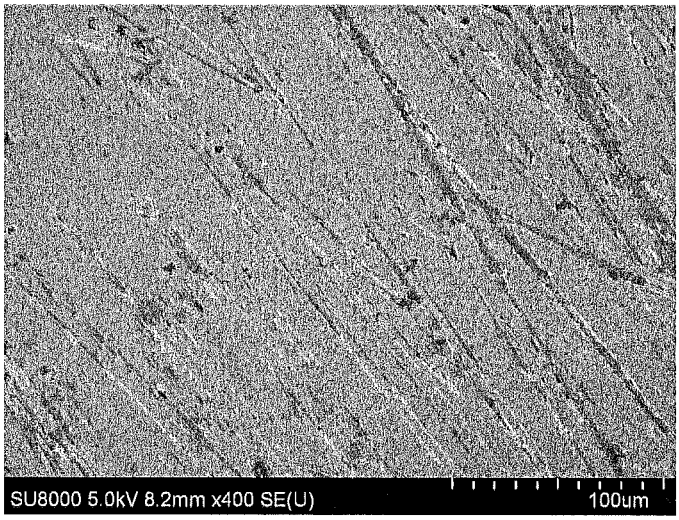
FIG. 5 is a scanning electron micrograph of the groove portion of the CNT-containing ITO film having the grooves formed by grinding with sandpaper.

An FEL device was formed and evaluated in the same manner as in Example 1 except that the #1000 sandpaper was changed to a #8000 lapping film sheet (produced by 3M company). The observation result of the surface of the CNT-containing ITO film after grinding is shown in FIG. 5.

The grooves having a width of from 0.1 to 50 μm had a total extension of 120 mm per 1 $mm^2$. The depth of the grooves was measured at 10 points of the grooves with a surface roughness meter, and was 0.1 μm or more in all the points. A light emission device was fabricated and measured for light emission luminance at five points, which were in a range of from 200 to 220 cd/$cm^2$, and the average value thereof was 208 cd/$cm^2$. In this Example, it was confirmed that flicker in light emission (fluctuation in light emission intensity observed visually) was small, and the voltage required for light emission was low, as compared to Comparative Example 1.

The invention claimed is:

1. A field electron emission film comprising from 60 to 99.9% by mass of tin-doped indium oxide and from 0.1 to 20% by mass of carbon nanotubes, having such a structure that grooves having a width in a range of from 0.1 to 50 μm are formed in a total extension of 2 mm or more per 1 $mm^2$ on a surface of the film, and carbon nanotubes are exposed on a wall surface of the grooves.

2. A field electron emission device comprising the field electron emission film according to claim 1 formed on a substrate.

3. A light emission device comprising the field electron emission device according to claim 2, as a cathode electrode, and a structure as an anode being disposed to face the field electron emission device and containing an anode electrode and a fluorescent material, wherein a space between the field electron emission device and the anode is maintained in a vacuum.

4. A method for producing a field electron emission film according to claim 1, comprising: coating a carbon nanotube dispersion liquid containing an organic indium compound, a tin alkoxide, tin-doped indium oxide particles, and carbon nanotubes, on a substrate, and heating the dispersion liquid to form a tin-doped indium oxide film containing carbon nanotubes; and then forming grooves having a width in a range of from 0.1 to 50 μm in a total extension of 2 mm or more per 1 $mm^2$ on a surface of the film in order to expose the carbon nanotubes on a wall surface of the grooves.

5. The method for producing a field electron emission film according to claim 4, wherein a formation method of the grooves is mechanical grinding with abrasive grains.

* * * * *